US008647564B2

(12) United States Patent
Ahn et al.

(10) Patent No.: US 8,647,564 B2
(45) Date of Patent: Feb. 11, 2014

(54) HIGH-STRENGTH STEEL SHEET WITH EXCELLENT LOW TEMPERATURE TOUGHNESS AND MANUFACTURING THEREOF

(75) Inventors: Seong Soo Ahn, Pohang (KR); Jang Yong Yoo, Pohang (KR); Ki Ho Kim, Pohang (KR); Choong Jae Park, Pohang (KR); Tae Woo Lee, Pohang (KR)

(73) Assignee: POSCO (KR)

( * ) Notice: Subject to any disclaimer, the term of this patent is extended or adjusted under 35 U.S.C. 154(b) by 390 days.

(21) Appl. No.: 12/746,073

(22) PCT Filed: Nov. 12, 2008

(86) PCT No.: PCT/KR2008/006666

§ 371 (c)(1), (2), (4) Date: Jun. 3, 2010

(87) PCT Pub. No.: WO2009/072753

PCT Pub. Date: Jun. 11, 2009

(65) Prior Publication Data

US 2010/0258219 A1 Oct. 14, 2010

(30) Foreign Application Priority Data

Dec. 4, 2007 (KR) ..... 10-2007-0124672
May 15, 2008 (KR) ..... 10-2008-0045190

(51) Int. Cl.
*C22C 38/00* (2006.01)
*C21D 8/02* (2006.01)

(52) U.S. Cl.
USPC ..... 420/84; 148/645; 148/320

(58) Field of Classification Search
USPC ..... 420/84; 148/645, 320
See application file for complete search history.

(56) References Cited

U.S. PATENT DOCUMENTS

| | | | | |
|---|---|---|---|---|
| 6,632,296 | B2 | 10/2003 | Yoshinaga et al. | |
| 7,520,943 | B2 | 4/2009 | Ishikawa et al. | |
| 2001/0027831 | A1* | 10/2001 | Toyooka et al. | 148/333 |
| 2003/0217795 | A1* | 11/2003 | Asahi et al. | 148/593 |
| 2006/0266445 | A1* | 11/2006 | Yokoi et al. | 148/533 |

(Continued)

FOREIGN PATENT DOCUMENTS

| | | | |
|---|---|---|---|
| EP | 1231289 | A1 | 8/2002 |
| EP | 1662014 | A1 | 5/2006 |

(Continued)

OTHER PUBLICATIONS

Xiao, Fu-Ren, et al. "Challenge of mechanical properties of an acicular ferrite pipeline steel." Materials Science and Engineering: A 431.1 (2006): 41-52.*

*Primary Examiner* — Jessee Roe
(74) *Attorney, Agent, or Firm* — The Webb Law Firm

(57) ABSTRACT

There is provided a high-strength steel plate having acicular ferrite and bainite as a main microstructure and an austenite/martensite (M & A) as a second phase under the control of a cooling rate above the austenite transformation temperature. The high-strength steel plate comprises: carbon (C): 0.03 to 0.10 wt %, silicon (Si): 0.1 to 0.4 wt %, manganese (Mn): 1.8 wt % or less, nickel (Ni): 1.0 wt % or less, titanium (Ti): 0.005 to 0.03 wt %, niobium (Nb): 0.02 to 0.10 wt %, aluminum (Al): 0.01 to 0.05 wt %, calcium (Ca): 0.006 wt % or less, nitrogen (N): 0.001 to 0.006 wt %, phosphorus (P): 0.02 wt % or less, sulfur (S): 0.005 wt % or less, and the balance of iron (Fe) and other inevitable impurities. The method for manufacturing a high-strength steel plate may be useful to economically and effectively manufacture a high strength steel, which is able to secure excellent properties such as high strength and high toughness since the acicular ferrite and bainite may be effectively formed without adding expensive elements such as molybdenum (Mo).

6 Claims, 4 Drawing Sheets

(56) References Cited

U.S. PATENT DOCUMENTS

| | | | | |
|---|---|---|---|---|
| 2007/0181223 | A1 | 8/2007 | Ito et al. | |
| 2007/0193665 | A1* | 8/2007 | Furuya et al. | 148/653 |
| 2009/0301613 | A1* | 12/2009 | Koo et al. | 148/537 |

FOREIGN PATENT DOCUMENTS

| | | | |
|---|---|---|---|
| JP | 3013524 | A | 1/1991 |
| JP | 8060292 | A | 3/1996 |
| JP | 2005048289 | A | 2/2005 |
| JP | 2005060840 | A | 3/2005 |
| KR | 20010002776 | A | 1/2001 |
| KR | 20030081050 | A | 10/2003 |
| KR | 20060072196 | A | 6/2006 |
| KR | 20060130700 | A | 12/2006 |
| KR | 100723156 | B1 | 5/2007 |

* cited by examiner

HIGH-STRENGTH STEEL SHEET WITH EXCELLENT LOW TEMPERATURE TOUGHNESS AND MANUFACTURING THEREOF

TECHNICAL FIELD

The present invention relates to a steel plate capable of being used for line pipes, building structures, offshore structures and the like, and a manufacturing method thereof, and more particularly, to a high-strength steel plate capable of being stably used under severe environment since the steel plate has excellent low-temperature toughness, and a manufacturing method thereof.

BACKGROUND ART

To increase the operational efficiency of a line pipe, it is necessary to transport petroleum or gas at an increasing amount per hour. For this purpose, it is inevitable to secure a high strength of steel. Also, it has been essential for steel to secure low-temperature toughness as petroleum and gas diggings gradually spread into cold district.

Owing to an increasing demand for large structures such as building structures and offshore structures and an increasing severity of the severe operating conditions (an operational temperature, a connection structure, etc.), there has also been a gradually increasing demand for steel having high strength and high toughness.

In order to facilitate improvement of the steel strength, a technology of improving both hardness and strength of a steel plate has been proposed in the prior art, comprising: adding an element for improving hardenability to form a low-temperature transformation phase during a cooling process. However, the proposed technology has a problem in that, when a low-temperature transformation microstructure such as martensite is formed inside a steel plate, the toughness of the steel plate may be severely deteriorated due to its inner residual stress. That is to say, since the steel plate has two incompatible physical properties, namely strength and toughness, it has been recognized in the art that the toughness of the steel is decreased with strength.

Since then, there has been a continuous attempt to provide a high strength steel with high toughness. As a result of this attempt, a thermo mechanical controlling process (TMCP) was presented and has been used for a high strength steel with high toughness.

The TMCP is the general term for processes of controlling the reduction ratio by rolling and rolling temperature so as to fabricate a steel plate with desired physical properties. Here, the conditions of TMCP may depend on desired physical properties. In this case, the TMCP is generally divided into two steps: a controlled rolling process at a high temperature under strict conditions and an accelerated cooling process at a suitable cooling rate.

The steel plate with TMCP may be composed of fine grains inside a steel plate or have desired microstructure according to conditions of TMCP. Theoretically, therefore, it is possible to easily control physical properties of the steel plate for desired properties.

In order to manufacture a steel plate having a desired strength by means of the accelerated cooling process of the TMCP, it is necessary to form a hard microstructure in the steel plate, as described in the prior art. Therefore, it is still necessary to add an alloying element for improving hardenability in order to form a low-temperature transformation microstructure as a hard microstructure.

This hardenability-improving element has a problem associated with an increase in the manufacturing cost since it is very expensive. Therefore, there have been ardent attempts to enhance the strength of steel in the field of high-strength steel. Also, there have been continuous attempts to secure the low-temperature toughness of steel.

In general, the rolling process of the TMCP is widely divided into two methods according to finish rolling temperature and start cooling temperature. First, one is a single-phase region rolling process in which the finish rolling temperature and cooling are carried out above $Ar_3$ temperature at which austenite is transformed into a ferrite microstructure, and the other is a dual-phase region rolling process in which the finish rolling temperature and cooling are carried out below the $Ar_3$ temperature.

The single-phase region rolling process has advantages in that the load in rolling mill facilities is low since the rolling temperature of the single-phase region rolling process is higher than that of dual-phase region rolling process, and the manufacturing cost may be reduced since the rolling time of the single-phase region rolling process is shorter than that of dual-phase region rolling process. However, the single-phase region rolling process has a lot of problems in that the addition of expensive alloying elements with excellent hardenability is required to improve the steel strength since a transformation microstructure may be formed during a cooling process, but the addition of the alloying elements may impose a heavy burden on the manufacturing cost, and ununiform transformation in an inner part of a prepared steel plate may occur during the cooling process, which leads to a poor flatness of the steel plate.

On the contrary, since hardenable elements add little amount since transformation from austenite to ferrite occurs during rolling process, the dual-phase region rolling process does not have a problem associated with the increase in the cost by the addition of the alloying elements, but the load in the rolling mill facilities is high due to the low rolling temperature, and the manufacturing cost may be increased due to the long manufacturing time.

By making practical application of the conventional TMCP, various methods for manufacturing structural steel have been proposed in the prior art. For example, there is one technology of manufacturing steel having a bainite or martensite microstructure as a low-temperature transformation phase, including; rolling steel a temperature right above $Ar_3$ temperature and performing accelerated cooling of the rolled steel to approximately 150 to 500° C.

However, this technology has a problem in that, since polygonal ferrite in the rolled steel may be formed according to the initial cooling rate, it is not easy to realize a suitable cooling rate according to the alloying components. Also, since the steel is rolled up to the temperature right above $Ar_3$ temperature, the load may be given to the rolling mill facilities, and simultaneously the rolling time may be extended, which leads to the high manufacturing cost.

As another alternative, there is a technology for securing sufficient low-temperature toughness of steel while employing the conventional TMCP, for example, further including: tempering a steel plate below an $Ac_1$ transformation temperature (a temperature where ferrite is transformed into an austenite).

However, this technology should further include a heating operation so as to temper the steel plate after cooling the steel plate. Therefore, the technology still has a problem in that energy for the steel production may be increasingly used, and the manufacturing cost may be high due to the additional tempering process.

Therefore, there is a continuous demand for an epoch-making and stable method for manufacturing a steel plate that may solve the above problems.

DISCLOSURE OF INVENTION

Technical Problem

The present invention is designed to solve the problems of the prior art, and therefore it is an object of the present invention to provide a steel plate having excellent properties such as strength and low-temperature toughness, which is able to reduce the manufacturing cost by shortening the rolling time without the addition of expensive alloying elements.

Also, it is another object of the present invention to provide a method for manufacturing a steel plate according to one exemplary embodiment of the present invention.

SUMMARY OF THE INVENTION

According to an aspect of the present invention, there is provided a high-strength steel plate having excellent low-temperature toughness. Here, high-strength high-toughness steel plate includes: carbon (C): 0.03 to 0.10 wt %, silicon (Si): 0.1 to 0.4 wt %, manganese (Mn): 1.8 wt % or less, nickel (Ni): 1.0 wt % or less, titanium (Ti): 0.005 to 0.03 wt %, niobium (Nb): 0.02 to 0.10 wt %, aluminum (Al): 0.01 to 0.05 wt %, calcium (Ca): 0.006 wt % or less, nitrogen (N): 0.001 to 0.006 wt %, phosphorus (P): 0.02 wt % or less, sulfur (S): 0.005 wt % or less, and the balance of iron (Fe) and other inevitable impurities.

In this case, a microstructure of the steel plate may have acicular ferrite and bainite as a main microstructure and an austenite/martensite (M&A) as a second phase, and the acicular ferrite may have a grain size limit of 10 μm (micrometers) or less (excluding 0 (μm)), and the bainite may have a packet size limit of 5 μm (micrometers) or less (excluding 0 (μm)).

Also, the austenite/martensite constituent (M&A) may have an area fraction of 10% or less (excluding 0%). Here, a yield strength of the high-strength steel plate may be in a range of 500 to 650 MPa, and a Charpy impact-absorbed energy may be 300 J or more at −40° C.

According to an aspect of the present invention, there is provided a method for manufacturing a high-strength high-toughness steel plate. Here, the method includes: heating a steel slab at 1050 to 1180° C., wherein the steel slab comprises: carbon (C): 0.03 to 0.10 wt %, silicon (Si): 0.1 to 0.4 wt %, manganese (Mn): 1.8 wt % or less, nickel (Ni): 1.0 wt % or less, titanium (Ti): 0.005 to 0.03 wt %, niobium (Nb): 0.02 to 0.10 wt %, aluminum (Al): 0.01 to 0.05 wt %, calcium (Ca): 0.006 wt % or less, nitrogen (N): 0.001 to 0.006 wt %, phosphorus (P): 0.02 wt % or less, sulfur (S): 0.005 wt % or less, and the balance of iron (Fe) and other inevitable impurities; a first hot-rolling the heated steel slab within a first temperature range in which austenite recrystallizes in one or more passes (First rolling step); a second hot rolling of the firstly hot-rolled steel plate in one or more passes to prepare a finish-rolled steel plate within a second temperature range, somewhat lower than the first temperature range, at which austenite does not recrystallize and above the $Ar_3$ (Second rolling step); cooling the finish-rolled steel plate to 300 to 600° C. (Accelerated cooling operation); and air-cooling, or keeping the cooled hot-rolled steel plate at a room temperature.

In this case, a reduction ratio at the first rolling step may be in a range of 20 to 80%, and a reduction ratio at the second rolling step may be in a range of 60 to 80%. Also, the accelerated cooling process may include two steps: the first step is cooling the finish-rolled steel plate between a bainite transformation start temperature (Bs) and an $Ar_3$ temperature at a cooling rate of 30 to 60° C./sec (First cooling step); cooling the firstly cooled hot-rolled steel plate to 300 to 600° C. at a cooling rate of 10 to 30° C./sec (Second cooling step).

As described above, the steel plate according to one exemplary embodiment of the present invention and the method for manufacturing a steel plate may be useful to effectively manufacture a structural steel capable of securing excellent properties such as high strength and high toughness since the acicular ferrite and bainite is effectively formed in the steel plate without addition of expensive alloying elements such as Mo.

BEST MODE FOR CARRYING OUT THE INVENTION

Figure 1:
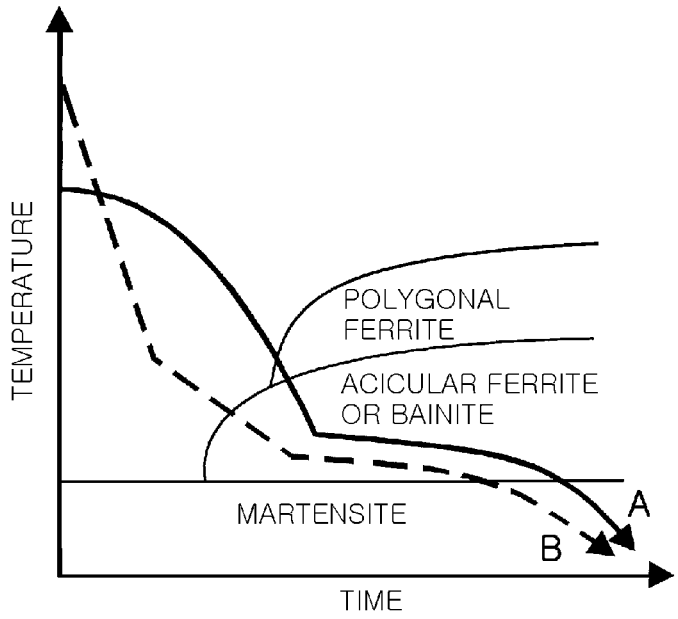
FIG. 1 is a schematic view illustrating cooling processes in a conventional manufacturing method of a steel plate and a manufacturing method of a steel plate according to one exemplary embodiment of the present invention: the symbol, A, represents the conventional cooling method, and the symbol, B, represents the cooling method of the present invention.

Hereinafter, exemplary embodiments of the present invention are now described in more detail.

In order to solve the above prior-art problems, the present inventors have found that a microstructure in a steel plate having excellent strength and toughness may be formed by employing a single-phase region rolling method to shorten a manufacturing time and enhance strength of the steel plate, wherein the method is used to increase an initial cooling rate. Therefore, the present invention was completed, based on the above facts.

Hereinafter, the conditions, such as a composition of the steel plate, a substructure and a manufacturing method, of the present invention to achieve the above-mentioned objects of the present invention are sequentially described in more detail.

(Composition)

In accordance with one exemplary embodiment of the present invention, the composition of the steel plate is defined to such extent that the steel plate can have sufficient strength and toughness of welds.

Carbon (C): 0.03 to 0.10 Wt %

Carbon (C) is element that is most effective at strengthening metal and base of the welds through solution strengthening, and also provides precipitation strengthening, primarily through the formation of small iron carbides (cementite), carbonitrides of niobium[Nb(C,N)], carbonitrides of vanadium [V(C,N)], and particles or precipitates of $Mo_2C$ (a form of molybdenum carbide). In addition, the Nb carbonitrides may function to improve both strength and low-temperature toughness of a steel plate by means of the refinement of austenite grains by retarding the austenite recrystallization and inhibiting the grain growth during a hot-rolling process.

Carbon also increases hardenability, i.e., the ability to form harder and stronger microstructures in steel during cooling. When the C content is less than 0.03 wt %, these effects are not obtained, whereas when the C content exceeds 0.1 wt %, the steel is generally susceptible to cold cracking after field welding and to lowering of toughness in the steel plate and in its weld HAZ.

Silicon (Si): 0.1 to 0.4 Wt %

Silicon (Si) functions to assist Al to deoxidize a molten steel and serves as a solution strengthening element. Therefore, Si is added at a content of 0.1 wt % or more. On the contrary, when Si is added at a content greater than 0.4 wt %, red scales may be formed by Si during the rolling process, and therefore a surface shape of the steel plate may be poor and the field weldability of the steel plate and the toughness of its weld heat-affected zone may be deteriorated. However, there is no need to add Si to deoxidize the molten steel since Al or Ti also has a deoxidation function.

Manganese (Mn): 1.8 Wt % or Less

Manganese (Mn) is an element that is effective at solution-strengthening steel. Therefore, Mn is added to enhance strength of steel since it has an effect to improve hardenability of the steel. However, when Mn is added at a content greater than 1.8 wt %, the center segregation may be facilitated during a slab-molding operation of the steel-making process, and the toughness of steel may also be deteriorated. Additionally, the excessive addition of the Mn allows the hardenability of steel to be excessively improved, which leads to the poor field weldability, and thus the deteriorated toughness of the weld heat-affected zone.

Nickel (Ni): 1.0 Wt % or Less

Nickel (Ni) is an element that functions to improve physical properties of low-carbon steel without adversely affecting the in-situ weldability and low-temperature toughness of the low-carbon steel. In particular, Ni is used to form a small amount of a hard phase such as martensitic-austenite constituent, which has been known to degrade the low-temperature toughness of the low-carbon steel, and also improve the toughness in the weld heat-affected zone, compared with the components Mn and Mo.

Also, Ni functions to suppress the occurrence of surface cracks generated in Cu-added steel during continuous molding and hot-rolling processes. However, Ni is very expensive, and the excessive addition of the Ni may rather deteriorate the toughness of the weld heat-affected zone. Therefore, the upper limit of Ni addition is set about 1.0 wt %.

Titanium (Ti): 0.005 to 0.03 Wt %

Titanium (Ti) contributes to the grain refinement by forming fine Ti nitrides particles (TiN) to suppress coarse distribution of austenite grains during slab reheating. In addition, the TiN functions to improve the toughness of steel by removing N from molten steel, as well as to prevent the coarse distribution of austenite grains in a weld heat-affected zone. In order to sufficiently remove N, Ti is added at a content 3.4 time higher than the added N.

Also, Ti is an element that is useful to enhance the strength of a base metal and a weld heat-affected zone and refine grains of the base metal and a weld heat-affected zone. Therefore, Ti has an effect to suppress the growth of grains in a heating process prior to the rolling process since it is present in the form of TiN in steel. Also, Ti that remains after the reaction with nitrogen is melted into the steel, and binds to carbon to form TiC precipitation. In this case the resulting TiC precipitation is so fine to highly improve the strength of steel.

In particular, when the content of the added Al is very low, Ti is formed into Ti oxide, which serves as a nucleation site of intragranular acicular ferrite in the weld heat-affected zone. In order to suppress the growth of austenite grains by TiN precipitation and form the TiC precipitation to enhance the strength of steel, Ti should be added at a content of at least 0.005 wt %.

Meanwhile, when the content of the added Al exceeds 0.03 wt %, the Ti nitrides are formed with coarse microstructure and excessively cured by the Ti carbides, which adversely affect the low-temperature toughness of steel. Also, when a steel plate is welded to produce a steel pipe, the steel plate is suddenly heated to its melting point to dissolve the TiN into a solid solution, which leads to the deteriorated toughness in the weld heat-affected zone. Therefore, the upper content limit of the added Ti is set to 0.03 wt %.

Niobium (Nb): 0.02 to 0.10 Wt %

Niobium (Nb) functions to improve strength and toughness of steel at the same time by refining austenite grains. Nb carbonitrides generated during a hot-rolling process refine the austenite grains by retarding austenite recrystallization and inhibiting grain growth. In particular, it has been known that, when Nb is added together with Mo, Nb functions to retard the austenite recrystallization and improve the refinement of austenite grains, and also has a solution strengthening effect by the precipitation strengthening and the improvement in hardenability.

In order to achieve these effects, Nb is present at a content of 0.02 wt % or more according to one exemplary embodiment of the present invention. In particular, Nb may raise the austenite no-recrystallization temperature ($T_{nr}$) to increases a rolling temperature. Therefore, Nb is more preferably present at a content of 0.035 wt % by or more so as to reduce the manufacturing cost.

However, when Nb is added at a content greater than 0.10 wt %, it is difficult to expect the further improvement in the strength and toughness of steel, and, since the austenite no-recrystallization temperature is extremely increased due to the excessive precipitation of Nb carbonitrides, the anisotropy of material and the manufacturing cost may be high, and the weldability and toughness at a weld heat-affected zone may be adversely affected.

Aluminum (al): 0.01 to 0.05 Wt %

Aluminum (Al) is generally added for the purpose of deoxidation of steel. Also, the toughness in the weld heat-affected zone may be improve by refining a microstructure and removing N from a coarse grain region of the weld heat-affected zone. Therefore, Al is added at a content of 0.01 wt %.

However, when the Al is added at a content greater than 0.05 wt %, Al oxides ($Al_2O_3$) may be formed to degrade the toughness of the base metal and the weld heat-affected zone. Also, the deoxidation may be carried out by the addition of Ti and Si. Therefore, the Al should not be essentially added.

Calcium (Ca): 0.006 Wt % or Less

Calcium (Ca) is widely used to control the shape of MnS inclusion and improve the low-temperature toughness of steel. However, when Ca is added at an excessive content, a large amount of CaO—CaS is formed and bonded to each other, thereby forming a coarse inclusion. In order to prevent the cleanliness of steel from being degraded and improve the field weldability of the steel as well, the upper content limit of Ca is defined to 0.006 wt %.

Nitrogen (N): 0.001 to 0.006 Wt %

Nitrogen (N) functions to suppress the growth of austenite grains during heating of a slab, and TiN precipitate functions to suppress the growth of austenite grains in the weld heat-affected zone. However, the excessive addition of the N facilitates the defects in a slab surface, and the presence of dissolved nitrogen results in the deteriorated toughness of the base metal and the weld heat-affected zone.

Phosphorus (P): 0.02 Wt % or Less

Phosphorus (P) binds to Mn to form a nonmetallic inclusion. Here, since the resultant nonmetallic inclusion causes the embrittlement of steel, it is necessary to actively decrease the P content. However, when the P content is reduced to a limiting value, the loads in the steel-making process may be deeply increased, whereas when the P content is less than 0.02 wt %, the embrittlement of steel is not seriously caused. Therefore, the upper content limit of P is set to 0.02 wt %.

Sulfur (S): 0.005 Wt % or Less

Sulfur (S) is an element that binds to Mn to form a nonmetallic inclusion. Here, the resultant nonmetallic inclusion causes the embrittlement of steel and the red brittleness. Like the component P, the upper content limit of S is defined to 0.005 wt % in consideration of the loads in the steel-making process.

The Other Components

The present invention is designed to overcome the problem associated with the hardenability of steel by using a cooling rate instead of adding an alloying element having an effect to improve a cooling capacity. Therefore, the present invention is based on the fact that representative element improving the hardenability of steel, for example, such as Mo, Cr and V, are not added. However, when the limitations on installation of steel products makes it difficult to achieve the cooling rate proposed in one exemplary embodiment of the present invention, a trace of the hardenability-improving element may be added.

(Microstructure)

Kinds and shapes of a microstructure should be further defined under a preferred condition where the steel plate having the above-mentioned components and their contents is manufactured into a high-strength, high-toughness steel plate having an excellent plate flatness.

That is to say, a substructure of the steel plate proposed in the present invention has a main microstructure composed of acicular ferrite and bainite microstructures, and also has a second phase microstructure such as an austenite/martensite (M&A) microstructure.

Here, a grain size of acicular ferrite and a packet size of bainite are major factors that have a dramatic effect on the impact toughness of steel. Therefore, the smaller the major factors are, the better the impact toughness of steel is. Accordance with one exemplary embodiment of the present invention, the grain size of acicular ferrite is defined up to 10 μm (micrometers), and the packet size of bainite is defined up to 5 μm (micrometers).

When the austenite/martensite (M&A) as the second phase structure, except for the main structure, is excessively distributed over the microstructure of the steel plate, the austenite/martensite (M&A) may be mainly responsible for degrading the toughness of steel. Therefore, the content of the austenite/martensite (M&A) is defined to 10% or less, based on the area fraction of the microstructure of the steel plate.

The steel plate according to one exemplary embodiment of the present invention having this component system and the microstructure may have a yield strength of 500 to 650 MPa and show its Charpy impact-absorbed energy at −40° C. of 300 J or more.

(Manufacturing Method)

Generally, the method for manufacturing a steel plate according to one exemplary embodiment of the present invention includes: heating a slab, hot-rolling the heated slab within a first temperature range in which austenite recrystallizes at least one or two times, finish-rolling the hot-rolled slab at least one or two times at a temperature below the austenite recrystallization temperature, cooling the finish-rolled steel plate in two cooling steps, and finishing the cooling. And, the steel plate is cooled with the air, or kept at a room temperature after cooling the steel plate after the cooling finish temperature.

Hereinafter, respective operations of the manufacturing method according to one exemplary embodiment of the present invention are now described in more detail.

Slab-Heating Temperature: 1050 to 1180° C.

The slab-heating process is to heat steel so as to facilitate a subsequent rolling process and sufficiently have desired physical properties of a steel plate. Therefore, the heating process should be carried out within a suitable temperature range, depending on the purposes.

The most important thing in the heating process is to prevent excessively coarse distribution of grains caused by the too high heating temperature to the maximum, as well as heat a slab uniformly so that precipitating elements in the steel plate can be sufficiently dissolved into a solid solution.

When the heating temperature of the slab is below 1050° C., Nb is not dissolved into a solid solution of steel, which makes it difficult to obtain a steel plate with high strength. Also, the grains are partially recrystallized to form uniform austenite grains, which makes it difficult to obtain a steel plate with high toughness. On the contrary, when the heating temperature of the slab exceeds 1180° C., the austenite grains are excessively distributed coarsely, which leads to an increase in the grain size of the steel plate and the highly deteriorated toughness of the steel plate.

Control of Rolling Conditions

Austenite grains should be present in such a fine grain size that the steel plate can show its low-temperature toughness. This may be possible carried out by controlling a rolling temperature and a reduction ratio. It is characterized in that the rolling operation according to one exemplary embodiment of the present invention is carried out in two temperature regions. Also, since recrystallization behaviors in each temperature region are different from each other, the rolling operation is set to separate conditions according to the temperature conditions.

(1) First Rolling Step: 20 to 80% of Rolling Reduction within Austenite Recrystallization Temperature Region A slab is rolled at least one or two times or more within an austenite recrystallization temperature region until a thickness of the slab reaches 20 to 80% of its initial thickness. The austenite grains may be reduced in size by the rolling within the austenite recrystallization temperature region. In the case of these multiple rolling operations, the reduction ratio and time should be carefully controlled to prevent the growth of austenite grains after the austenite recrystallization. The fine austenite grains formed in the above-mentioned processes function to improve toughness of the final steel plate.

(2) Second Rolling Step: 60 to 80% of Rolling Reduction Between $T_{nr}$ Temperature and $Ar_3$ Temperature After the first rolling step, the slab was rolled at least two times between an austenite recrystallization temperature ($T_{nr}$) region. In this case, the slab rolled between the austenite recrystallization temperature region was rolled until a thickness of the rolled slab reaches 60 to 80% of its initial thickness. Then, the rolling of the slab was finished at a temperature higher than the $Ar_3$ temperature (a temperature where austenite is transformed into a ferrite microstructure).

When the slab is rolled between $T_{nr}$ and $Ar_3$ temperatures, the grains are crushed, and a potential of the grains is increased by its inner deformation. Then, when the slab is cooled, the grains are easily transformed into an acicular ferrite and bainite. As the rolling finish temperature increases, the manufacturing time of a steel plate gets shorter, thereby redwing the manufacturing cost. This is possible when the initial cooling rate is high during the accelerated cooling operation. Additionally, a first cooling condition is described in more detail, as follows.

First Cooling Rate: 30° C./Sec or More

A cooling rate is one important factor to improve the toughness and strength of a steel plate. This is why an increase in the cooling rate facilitates the refinement of the grains in the substructure of the steel plate to improve the toughness of steel and the development of an inner hard microstructure to improve the strength of steel.

However, when the accelerated cooling from an austenite region is carried out like the present invention, polygonal ferrite may be formed during a cooling process. Therefore, the present invention is characterized in that the cooling rate is accelerated at the beginning of the cooling process so as to suppress the formation of the polygonal ferrite.

When the initial cooling rate is less than 30° C./sec, the polygonal ferrite may be formed, which makes it impossible to secure the strength and low-temperature toughness of steel. However, when the first cooling rate is accelerated to the extent that the first cooling rate does not meet a period of forming the polygonal ferrite although the cooling start temperature is high, it is possible to form a duplex microstructure of acicular ferrite and bainite, which is a microstructure required in the present invention.

That is to say, when the cooling rate may be controlled to a high level, preferably a level of 60° C./sec, it is possible to increase a cooling start temperature, which indicates that a steel slab may be rolled at a high temperature. Therefore, the loads in the rolling mill facilities is low and the rolling time may be saved due to the low rolling temperature, which leads to the low manufacturing cost.

The higher cooling rate makes it possible for the steel slab to show its more excellent effects. As shown in FIG. 1, it is, however, revealed that the formation of the polygonal ferrite is suppressed in the cooling method (B) of the present invention, compared to the conventional cooling method (A).

First Cooling Stop Temperature: Bs to $Ar_3$

The first cooling step is finished below the $Ar_3$ temperature where the austenite is transformed into the ferrite microstructure, and above the bainite transformation start temperature, Bs. More preferably, the first cooling step is stopped within a range of Bs+10° C. so as to stably obtain acicular ferrite and bainite.

Second Cooling Rate: 10 to 30° C./Sec

After the first cooling step, a second cooling step is carried out at a cooling rate of 10 to 30° C./sec so as to form the acicular ferrite and bainite. When a steel plate is cooled at a rate of less than 10° C./sec, residual austenite and M&A may be excessively increased in amount, which degrades the strength and toughness of steel plate. Therefore, the lower limit of the second cooling rate is set to 10° C./sec. However, when the steel plate is cooled at a rate of greater than 30° C./sec, the steel plate may be twisted due to the excessive cooling water, which leads to the defects in shape control of the steel plate.

Second Cooling Stop Temperature: 300 to 600° C.

To control a substructure of the steel plate, it is necessary to cool the steel plate to a temperature where the effects of the cooling rate are sufficiently expressed. When the cooling stop temperature where the cooling of the steel plate is stopped exceeds 600° C., it is difficult to sufficiently form fine grains and bainite phase inside the steel plate. Therefore, the upper limit of the cooling stop temperature should be set to 600° C.

Meanwhile, when the cooling stop temperature is below 300° C., the effects of the cooling rate may be saturated, and the steel slab may also be twisted due to the excessive cooling. In addition, the impact toughness of the steel plate may be deteriorated due to the excessive increase in strength.

Hereinafter, the following exemplary embodiments of the present invention are now described in more detail.

EXAMPLES

A 300 mm-thick slab was prepared, based on the components and their contents as listed in the following Table 1. Then, the slab was heated, rolled and cooled according to the manufacturing conditions as listed in the following Table 2 to prepare a 30 mm-thick steel plate.

TABLE 1

| Kinds | | C | Si | Mn | Ni | Ti | Nb | Al | Ca* | N* | P* | S* | $T_{nr}$ | $Ar_3$ |
|---|---|---|---|---|---|---|---|---|---|---|---|---|---|---|
| Inventive steels | A | 0.061 | 0.30 | 1.54 | 0.02 | 0.022 | 0.049 | 0.040 | 10 | 36 | 80 | 10 | 1015 | 774 |
| | B | 0.048 | 0.25 | 1.65 | 0.05 | 0.015 | 0.043 | 0.022 | 11 | 42 | 71 | 13 | 984 | 768 |
| | C | 0.052 | 0.27 | 1.38 | 0.07 | 0.024 | 0.036 | 0.021 | 12 | 34 | 60 | 9 | 954 | 787 |
| | D | 0.037 | 0.32 | 1.72 | 0.04 | 0.017 | 0.029 | 0.024 | 14 | 46 | 76 | 15 | 891 | 766 |
| Comp. steels | E | 0.025 | 0.18 | 1.52 | 0.41 | 0.026 | 0.032 | 0.030 | 12 | 38 | 65 | 12 | 959 | 766 |
| | F | 0.122 | 0.26 | 1.72 | 0.32 | 0.018 | 0.045 | 0.041 | 18 | 42 | 76 | 15 | 1035 | 725 |
| | G | 0.063 | 0.37 | 2.13 | 0.04 | 0.025 | 0.036 | 0.023 | 12 | 36 | 62 | 13 | 925 | 726 |
| | H | 0.062 | 0.25 | 1.64 | 0.22 | 0.021 | 0.120 | 0.032 | 15 | 45 | 62 | 15 | 1407 | 755 |
| | I | 0.053 | 0.21 | 1.58 | 0.31 | 0.024 | 0.015 | 0.028 | 13 | 39 | 62 | 14 | 885 | 758 |

(wherein, a temperature unit of $T_{nr}$ and $Ar_3$ is ° C. (Celsius), a content unit of elements marked with an asterisk (*) is ppm (parts per million), and a content unit of the other elements is wt %)

As listed in Table 1, it was revealed that the Inventive steels A to D satisfy all the requirements of the present invention, but the Comparative steels E to H do not satisfy the requirements of the present invention. That is to say, the Comparative steel E has a too low C content, and the Comparative steel F has an excessively high C content. Also, the Comparative steel G has an excessively high Mn content, the Comparative steel H has an excessively high Nb content, and the Comparative steel I has a too low Nb content.

TABLE 2

| Kinds | | | Slab heating Temp. (° C.) | No-recrystal-Ilization reduction ratio (%) | Rolling stop Temp. (° C.) | First cooling rate (° C./sec) | Second cooling rate (° C./sec) | Cooling stop Temp. (° C.) |
|---|---|---|---|---|---|---|---|---|
| Inventive steels | A | 1 | 1136 | 76 | 933 | 64.3 | 10.9 | 472 |
| | B | 1 | 1124 | 74 | 918 | 62.6 | 11.8 | 521 |
| | C | 1 | 1152 | 68 | 879 | 45.5 | 15.4 | 557 |
| | D | 1 | 1172 | 74 | 812 | 57.1 | 22.3 | 426 |
| Comp. steels | A | 2 | 1187 | 74 | 922 | 52.7 | 10.9 | 523 |
| | A | 3 | 1013 | 76 | 915 | 46.8 | 12.4 | 483 |
| | A | 4 | 1123 | 75 | 935 | 21.4 | 15.4 | 472 |
| | A | 5 | 1118 | 74 | 920 | 38.5 | 7.8 | 485 |
| | A | 6 | 1113 | 78 | 921 | 42.1 | 18.5 | 628 |
| | A | 7 | 1134 | 77 | 931 | 38.5 | 22.2 | 284 |
| | E | 1 | 1127 | 75 | 820 | 56 | 18.4 | 533 |
| | F | 1 | 1150 | 76 | 930 | 58 | 21.7 | 482 |
| | G | 1 | 1132 | 78 | 790 | 62 | 18.4 | 513 |
| | H | 1 | 1152 | 69 | 960 | 58 | 16.8 | 522 |
| | I | 1 | 1136 | 66 | 810 | 35 | 17.6 | 489 |

As listed in Table 2, it was revealed that the Inventive steels A1 to D1 satisfy all the requirements of the alloying composition and manufacturing conditions of the present invention, but the Comparative steels A2 to A7 has the same alloying composition as the Inventive steel A of Table 1 satisfying the alloying composition of the present invention but do not satisfy the manufacturing conditions of the present invention. And the Comparative steels E1 to I1 were prepared by applying the manufacturing conditions of the present invention to the steel slab having the alloying composition of the Comparative steels E to I listed in Table 1.

measured for fractions of acicular ferrite and bainite, a grain size of acicular ferrite and a packet size of bainite. Also, they were measured for tensile strength, and tensile properties and impact-absorbed energy through a Charpy impact test at −40° C. The measurement results are listed in the following Table 3. In Table 3, the tensile properties and the impact-absorbed energy refer to the test results in a direction (a circumferential direction of a pipe) vertical to the rolling direction.

Figure 2:
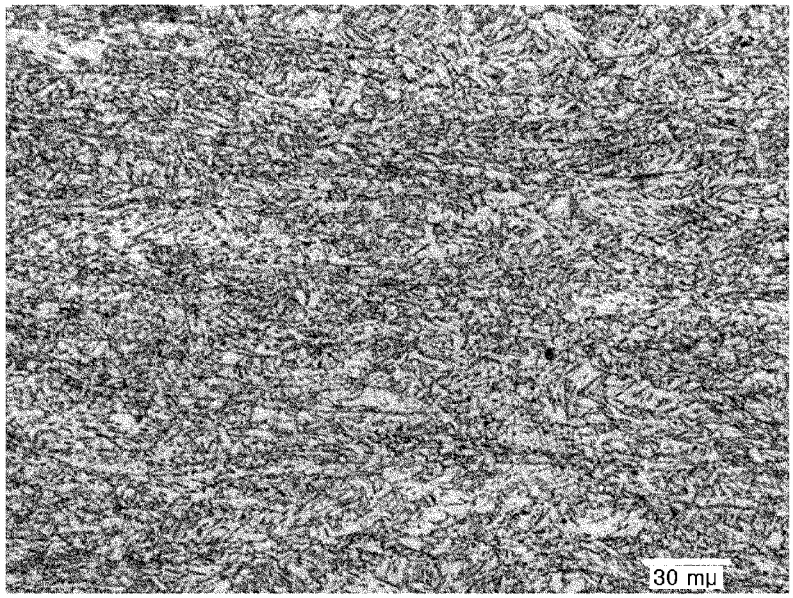
FIG. 2 is a photograph of Inventive steel A1, which has acicular ferrite and bainite as a main microstructure, taken with an optical microscope.
Figure 3:
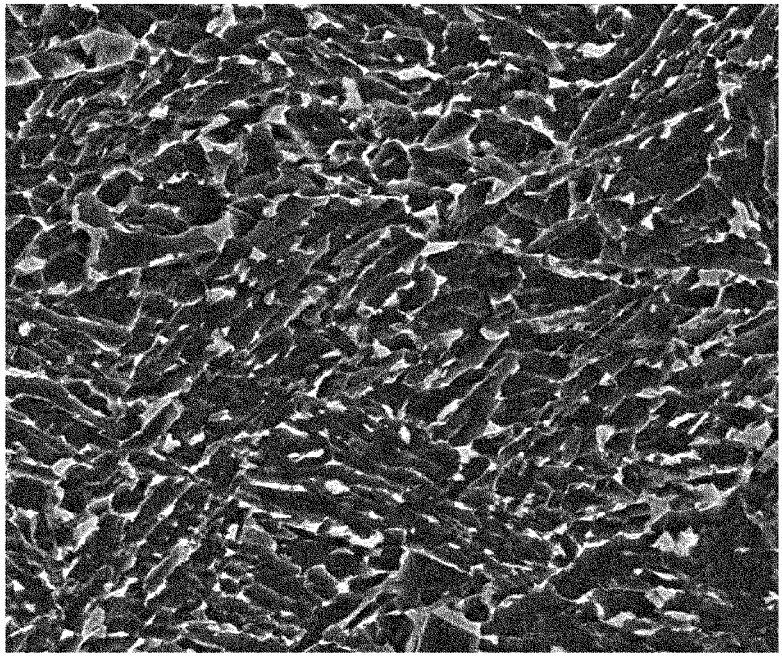
FIG. 3 is a photograph of the acicular ferrite as the main microstructure of the Inventive steel A1, taken with a scanning electron microscope.
Figure 4:
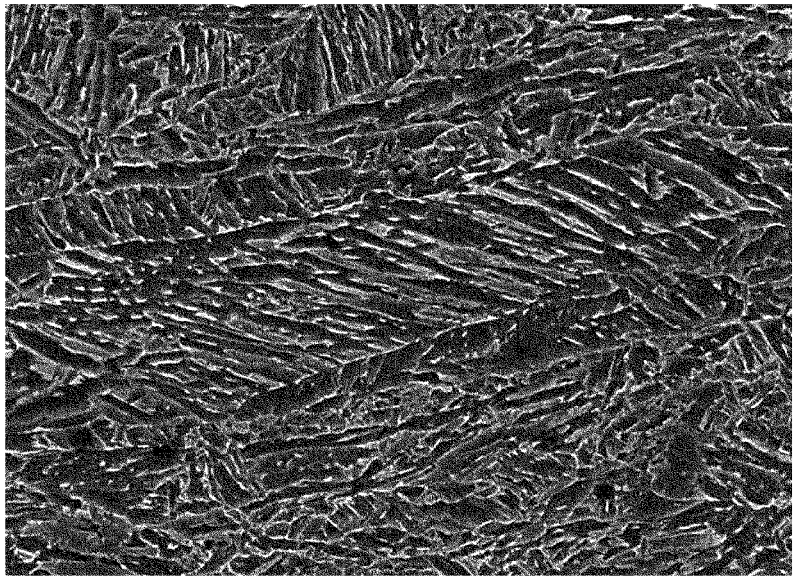
FIG. 4 is a photograph of the bainite as the main microstructure of the Inventive steel A1, taken with a scanning electron microscope.

Also, a microstructure of the Inventive steel A1 was observed, and the results are shown in FIGS. 2 to 4.

TABLE 3

| Kind | | | AF + B (%) | AF size (μm) | B size (μm) | Yield strength (MPa) | Tensile strength (MPa) | $vE_{-40° C.}$ (J) |
|---|---|---|---|---|---|---|---|---|
| Inventive steels | A | 1 | 95 | 6 | 3 | 525 | 624 | 371 |
| | B | 1 | 92 | 8 | 4 | 510 | 600 | 462 |
| | C | 1 | 93 | 7 | 4 | 523 | 617 | 406 |
| | D | 1 | 94 | 6 | 3 | 505 | 596 | 484 |
| Comp. steels | A | 2 | 92 | 8 | 16 | 520 | 621 | 186 |
| | A | 3 | 93 | 6 | 4 | 452 | 562 | 486 |
| | A | 4 | 82 | 8 | 3 | 462 | 545 | 330 |
| | A | 5 | 87 | 15 | 4 | 454 | 608 | 268 |
| | A | 6 | 64 | 7 | 4 | 432 | 526 | 368 |
| | A | 7 | 67 | 8 | 3 | 513 | 624 | 146 |
| | E | 1 | 76 | 12 | 8 | 421 | 520 | 488 |
| | F | 1 | 94 | 9 | 4 | 580 | 674 | 156 |
| | G | 1 | 93 | 7 | 15 | 514 | 615 | 124 |
| | H | 1 | 92 | 8 | 18 | 525 | 620 | 109 |
| | I | 1 | 94 | 7 | 25 | 486 | 575 | 78 |

AF: Acicular Ferrite,
B: Bainite

As listed in Table 2, it was revealed that the Inventive steels A1 to D1 satisfy all the requirements of the present invention. Also, it was revealed that the Comparative steel A2 has an excessively high slab-heating temperature, the Comparative steel A3 has an excessively low slab-heating temperature, the Comparative steel A4 has a very low first cooling rate, the Comparative steel A5 has a very low second cooling rate, the Comparative steel A6 has a very high cooling stop temperature, and the Comparative steel A7 has a very low cooling stop temperature.

Some parts of the steel plates prepared from the steel slab having the compositions as listed in Table 1 according to the manufacturing conditions as listed in Table 2 were taken and As listed in Table 3, it was revealed that all the Inventive steels having the compositions and manufacturing conditions as defined in the present invention show their desired tensile strength, and their impact-absorbed energy at −40° C. are also high with 300 J or more.

Also, FIG. 2 is a photograph illustrating acicular ferrite and bainite of Inventive steel A1, taken with an optical microscope, FIG. 3 is a photograph illustrating acicular ferrite of the Inventive steel A1, taken with a scanning electron microscope, and FIG. 4 is a photograph illustrating bainite of the Inventive steel A1, taken with a scanning electron microscope.

As shown in FIGS. 2 to 4, it was revealed that the Inventive steel A1 prepared in the present invention has fine acicular ferrite and bainite as the main microstructure.

On the contrary, it was revealed that the Comparative steels A2 to A7, which satisfy the requirement of the component systems of the present invention but has the different manufacturing conditions, does not have physical properties satisfying the requirement of the present invention.

That is to say:

① The slab heating temperature is excessively high in the case of the Comparative steel A2. In this case, a grain size of austenite may be distributed coarsely when the steel slab is extracted from a heating furnace. Therefore, the refinement of the austenite grains is not achieved even after the rolling process within the austenite recrystallization temperature, which leads to the increased packet size of the bainite, thus to the deteriorated impact-absorbed energy of the steel plate.

② The slab heating temperature is excessively low in the case of the Comparative steel A3. In this case, the solution strengthening effect is slightly expressed due to the presence of the alloying element, which leads to the deteriorated strength of the steel plate.

③ The Comparative steel A4 shows its low tensile strength since a polygonal ferrite is formed due to the very low first cooling rate.

④ The Comparative steel A5 has a low yield strength and impact-absorbed energy since the acicular ferrite and bainite are not sufficiently formed due to the very low second cooling rate, and the grain size of the acicular ferrite and the packet size of the bainite are distributed coarsely.

⑤ The Comparative steel A6 has a low tensile strength since the acicular ferrite and bainite are not sufficiently formed due to the very high cooling stop temperature.

⑥ The Comparative steel A7 has a high tensile strength, but shows its low impact-absorbed energy since the martensite and the like are formed due to the very low cooling stop temperature.

Meanwhile, it was shown that the Comparative steel E has excellent toughness but shows its seriously deteriorated tensile strength since the C content of the Comparative steel E is too low. The Comparative steels F, G and H has a satisfactory tensile strength but an insufficient impact-absorbed energy since the C, Mn and Nb content are excessively high in the Comparative steels, respectively.

In particular, the Comparative steel H having an excessively high Nb content does not show its sufficient effect on the grain refinement caused by the austenite recrystallization since the austenite no-recrystallization temperature is increased up to 1407° C. Also, the Comparative steel I shows its low impact-absorbing energy since the effect on the refinement of the austenite grains is not sufficiently achieved due to the very low Nb content in the Comparative steel I.

Accordingly, from the results of the above-mentioned Examples, it was revealed that the steels satisfying the requirement of the composition and the manufacturing conditions of the present invention have acicular ferrite and bainite as the main microstructure, show their excellent physical properties, and are excellent in terms of the cost and production efficiency as well.

The invention claimed is:

1. A high-strength steel plate, comprising: carbon (C): 0.03 to 0.10% by weight, silicon (Si): 0.1 to 0.4% by weight, manganese (Mn): 1.8 wt % or less, nickel (Ni): 1.0 wt % or less, titanium (Ti): 0.005 to 0.03 wt %, niobium (Nb): 0.02 to 0.10 wt %, aluminum (Al): 0.01 to 0.05 wt %, calcium (Ca): 0.006 wt % or less, nitrogen (N): 0.001 to 0.006 wt %, phosphorus (P): 0.02 wt % or less, sulfur (S): 0.005 wt % or less, and the balance of iron (Fe) and other inevitable impurities, wherein a microstructure of the steel plate comprises acicular ferrite and bainite as a main microstructure and an austenite/martensite (M&A) as a second phase, and wherein the acicular ferrite has a grain size of 10 μm (micrometers) or less (excluding 0), and the bainite has a packet size of 5 μm (micrometers) or less (excluding 0), wherein the microstructure of the steel comprises substantially no polygonal ferrite.

2. The high-strength steel plate of claim 1, wherein the austenite/martensite (M&A) has an area fraction of 10% or less (excluding 0%).

3. The high-strength steel plate of claim 1, wherein a yield strength of the high-strength steel plate is in a range of 500 to 650 MPa, and a Charpy impact-absorbed energy at −40° C. is 300 J or more.

4. The high-strength steel plate of claim 2, wherein a yield strength of the high-strength steel plate is in a range of 500 to 650 MPa, and a Charpy impact-absorbed energy at −40° C. is 300 J or more.

5. The high-strength steel plate of claim 1, wherein the acicular ferrite and bainite as the main microstructure has an area fraction of at least 90%.

6. The high-strength steel plate of claim 1, wherein the acicular ferrite and bainite as the main microstructure has an area fraction of at least 92%.

* * * * *

UNITED STATES PATENT AND TRADEMARK OFFICE

CERTIFICATE OF CORRECTION

PATENT NO. : 8,647,564 B2
APPLICATION NO. : 12/746073
DATED : February 11, 2014
INVENTOR(S) : Seong Soo Ahn et al.

It is certified that error appears in the above-identified patent and that said Letters Patent is hereby corrected as shown below:

On the Title Page, Item (54) and in the Specification, Column 1, Line 3, Title, after "Manufacturing" insert -- Method --

Signed and Sealed this
Twenty-seventh Day of May, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,647,564 B2
APPLICATION NO. : 12/746073
DATED : February 11, 2014
INVENTOR(S) : Ahn et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 481 days.

Signed and Sealed this
Twenty-ninth Day of September, 2015

Michelle K. Lee

Michelle K. Lee
*Director of the United States Patent and Trademark Office*